US009250545B2

(12) United States Patent
Iwasaki

(10) Patent No.: US 9,250,545 B2
(45) Date of Patent: Feb. 2, 2016

(54) ELECTROPHOTOGRAPHIC PHOTORECEPTOR, PROCESS CARTRIDGE, AND IMAGE FORMING APPARATUS

(71) Applicant: FUJI XEROX CO., LTD., Minato-ku, Tokyo (JP)

(72) Inventor: Masahiro Iwasaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/475,799

(22) Filed: Sep. 3, 2014

(65) Prior Publication Data

US 2015/0268567 A1 Sep. 24, 2015

(30) Foreign Application Priority Data

Mar. 24, 2014 (JP) ..... 2014-060563

(51) Int. Cl.
*G03G 5/06* (2006.01)
*G03G 5/05* (2006.01)

(52) U.S. Cl.
CPC ..... *G03G 5/0618* (2013.01); *G03G 5/0517* (2013.01); *G03G 5/0605* (2013.01); *G03G 5/0607* (2013.01); *G03G 5/0609* (2013.01)

(58) Field of Classification Search
CPC . G03G 5/0618; G03G 5/0607; G03G 5/0517; G03G 5/0609; G03G 5/0605
USPC ..... 430/58.25, 72, 83, 70, 58.05, 970
See application file for complete search history.

(56) References Cited

U.S. PATENT DOCUMENTS

| | | | | |
|---|---|---|---|---|
| 5,298,617 | A | 3/1994 | Nukada et al. | |
| 5,302,479 | A | 4/1994 | Daimon et al. | |
| 5,459,004 | A | 10/1995 | Daimon et al. | |
| 6,485,873 | B1 | 11/2002 | Ohkura et al. | |
| 2013/0288169 | A1* | 10/2013 | Yamano et al. | 430/56 |

FOREIGN PATENT DOCUMENTS

| | | | |
|---|---|---|---|
| JP | 4-189873 | A | 7/1992 |
| JP | 5-98181 | A | 4/1993 |
| JP | 5-140472 | A | 6/1993 |
| JP | 5-140473 | A | 6/1993 |
| JP | 5-263007 | A | 10/1993 |
| JP | 5-279591 | A | 10/1993 |
| JP | 06-123981 | * | 5/1994 |
| JP | 7-287407 | A | 10/1995 |
| JP | 2000-314969 | A | 11/2000 |
| JP | 2001-242656 | A | 9/2001 |
| JP | 2004-78147 | A | 3/2004 |
| JP | 2005-181992 | A | 7/2005 |
| JP | 2005-215677 | A | 8/2005 |

OTHER PUBLICATIONS

Grant, R. et al., ed., Grant & Hackh's Chemical Dictionary, fifth edition, McGraw-Hill Book Company, NY (1987), p. 240.*

Japanese Patent Office machine-assisted English-language translation of JP 06-123981 (pub. May 1994).*

* cited by examiner

*Primary Examiner* — Janis L Dote
(74) *Attorney, Agent, or Firm* — Sughrue Mion, PLLC

(57) ABSTRACT

An electrophotographic photoreceptor includes a conductive substrate and a single-layered photosensitive layer formed so as to overlie the conductive substrate, the photosensitive layer containing a binder resin, a charge-generating material, a hole-transporting material, an electron-transporting material represented by General Formula (1), and at least one compound selected from a compound represented by General Formula (2) and a compound represented by General Formula (3). The amount of the at least one compound selected from the compound represented by General Formula (2) and the compound represented by General Formula (3) is in the range of approximately 10 parts by weight to 100 parts by weight in total relative to 100 parts by weight of the electron-transporting material represented by General Formula (1).

[Chem. 1]

[Chem. 2]

[Chem. 3]

7 Claims, 2 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2014-060563 filed Mar. 24, 2014.

BACKGROUND

Technical Field

The present invention relates to an electrophotographic photoreceptor, a process cartridge, and an image forming apparatus.

SUMMARY

According to an aspect of the invention, there is provided an electrophotographic photoreceptor including a conductive substrate and a single-layered photosensitive layer formed so as to overlie the conductive substrate, the photosensitive layer containing a binder resin, a charge-generating material, a hole-transporting material, an electron-transporting material represented by General Formula (1), and at least one compound selected from a compound represented by General Formula (2) and a compound represented by General Formula (3), wherein the amount of the at least one compound selected from the compound represented by General Formula (2) and the compound represented by General Formula (3) is in the range of approximately 10 parts by weight to 100 parts by weight in total relative to 100 parts by weight of the electron-transporting material represented by General Formula (1).

General Formula (1)

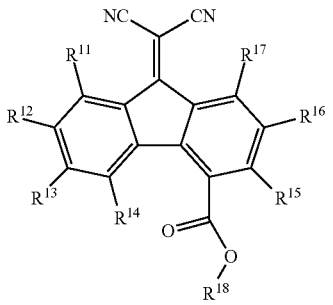

In General Formula (1), $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, an aryl group, or an aralkyl group; and $R^{18}$ represents an alkyl group, $-L^{41}-O-R^{42}$, an aryl group, or an aralkyl group, where $L^{41}$ represents an alkylene group, and $R^{42}$ represents an alkyl group.

General Formula (2)

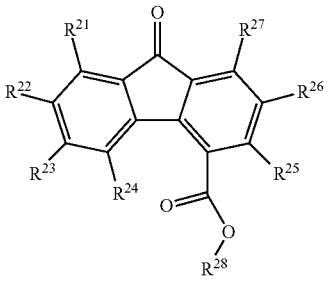

In General Formula (2), $R^{21}$, $R^{22}$, $R^{23}$, $R^{24}$, $R^{25}$, $R^{26}$, and $R^{27}$ each independently represent a hydrogen atom, a halogen atom, an alkyl group, an alkoxy group, an aryl group, or an aralkyl group; and $R^{28}$ represents an alkyl group, $-L^{51}-O-R^{52}$, an aryl group, or an aralkyl group, where $L^{51}$ represents an alkylene group, and $R^{52}$ represents an alkyl group.

General Formula (3)

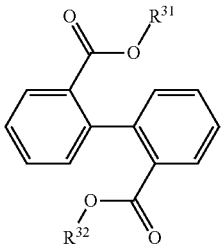

In General Formula (3), $R^{31}$ and $R^{32}$ each independently represent an alkyl group, $-L^{61}-O-R^{62}$, an aryl group, or an aralkyl group, where $L^{61}$ represents an alkylene group, and $R^{62}$ represents an alkyl group.

BRIEF DESCRIPTION OF THE DRAWINGS

Exemplary embodiment of the present invention will be described in detail based on the following figures, wherein.

DETAILED DESCRIPTION

Figure 1:
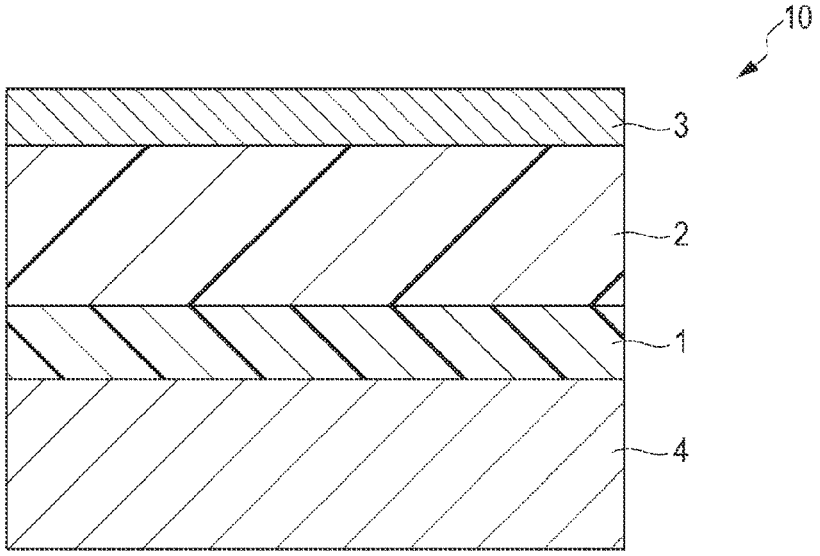
FIG. 1 is a schematic cross-sectional view partially illustrating an electrophotographic photoreceptor according to an exemplary embodiment.

An exemplary embodiment of the invention will now be described.

Electrophotographic Photoreceptor

An electrophotographic photoreceptor of an exemplary embodiment (hereinafter also referred to as "photoreceptor") is a positively chargeable organic photoreceptor including a conductive substrate and a single-layered photosensitive layer formed so as to overlie the conductive substrate (hereinafter also referred to as "single-layered photoreceptor").

The single-layered photosensitive layer contains a binder resin, a charge-generating material, a hole-transporting material, an electron-transporting material represented by General Formula (1), and at least one compound selected from a compound represented by General Formula (2) and a compound represented by General Formula (3) (hereinafter also referred to as "specific compound"). The amount of the at least one compound selected from the compound represented by General Formula (2) and the compound represented by General Formula (3) (hereinafter also referred to as "specific compound content") is in the range of approximately 10 parts by weight to 100 parts by weight in total relative to 100 parts by weight of the electron-transporting material represented by General Formula (1).

The single-layered photosensitive layer is a photosensitive layer which serves for generation of charges as well as for transportation of holes and electrons.

In the exemplary embodiment, the single-layered photosensitive layer contains the compound represented by General Formula (1), which serves as an electron-transporting material, and a predetermined amount of the specific compound. The fracture (hereinafter also referred to as "crack") of the surface of the photoreceptor is therefore reduced as compared with a case in which the specific compound content is out of the above-mentioned range. The cause of this reduction in the fracture of the surface of the photoreceptor has been still studied but is presumed as follows.

For example, in the case where the binder resin and electron-transporting material contained in the photosensitive layer are less compatible with each other, the electron-transporting material is affected by such compatibility inside the photosensitive layer as the photoreceptor is used, which may result in agglomeration or local crystallization of the electron-transporting material. Continued use of the photoreceptor in which the electron-transporting material has been agglomerated or crystallized inside the photosensitive layer easily leads the surface of the photoreceptor to be cracked, for instance, owing to additives or moisture contained in toner which exists on the surface of the photoreceptor in the form of a film (toner filming). Further using the photoreceptor having the cracked surface enlarges the cracks themselves or causes another damage derived from the cracks in some cases, which may result in image defects, such as a black spot caused by the enlarged cracks and a blurred image due to the damage derived from the cracks.

In the exemplary embodiment, the electron-transporting material represented by General Formula (1) is used, and a predetermined amount of the specific compound is added to the photosensitive layer. The specific compound has a chemical structure similar to that of a precursor obtained in a process for synthesizing the compound represented by General Formula (1), and such a chemical structure is also similar to that of the compound represented by General Formula (1). Hence, the specific compound contained in the photosensitive layer enhances the compatibility of the electron-transporting material represented by General Formula (1) with the binder resin to improve the dispersibility of the electron-transporting material, so that the above-mentioned agglomeration and crystallization are inhibited. It is presumed that this mechanism enables a reduction in cracks generated in the surface of the photoreceptor for a long time.

The electron-transporting material represented by General Formula (1), which is used in the exemplary embodiment, is a compound having a high electron mobility; in addition, in the case where a phthalocyanine compound is, for example, used as the charge-generating material, the electron-transporting material can readily receive electrons from the charge-generating material.

Hence, using the electron-transporting material represented by General Formula (1) in combination with the specific compound of which the amount is within the above-mentioned range enables both good electrical properties and a reduction in cracks.

When an image is formed with an image forming apparatus including the photoreceptor of the exemplary embodiment, an image in which an image defect due to cracks (e.g., an image to be formed is prolonged on the basis of the positions of the cracks) is reduced can be formed as compared with the case of using a photoreceptor in which the specific compound content is below the above-mentioned range.

In the case where the specific compound content is excessive, the specific compound serves as a plasticizer, and the film strength of the whole photosensitive layer is lowered; thus, the surface may be readily damaged. In the exemplary embodiment, however, the specific compound content that is within the above-mentioned range gives a good resistance to damage.

In the case where an image forming apparatus including the photoreceptor of the exemplary embodiment is used to form an image, the formed image is less likely to suffer from a blur brought about by the above-mentioned damage as compared with the case of using a photoreceptor in which the specific compound content exceeds the above-mentioned range.

The specific compound content is in the range of approximately 10 parts by weight to 100 parts by weight as described above, preferably approximately 15 parts by weight to 80 parts by weight, and more preferably approximately 25 parts by weight to 60 parts by weight.

In the exemplary embodiment, at least the compound represented by General Formula (2) can be used as the specific compound in the photosensitive layer, which can restrain electrical properties from being impaired as a result of using the photoreceptor. The cause of such restraint has been still studied but is presumed as follows.

The compound represented by General Formula (2) has a function of transporting electrons by itself; in addition, it is likely to enhance the dispersibility of the electron-transporting material represented by General Formula (1) in the binder resin as described above. Hence, using the electron-transporting material represented by General Formula (1) and the compound represented by General Formula (2) in combination further improves transportation of electrons; besides, this improved transportation of electrons is maintained, so that impairment of electrical properties resulting from use of the photoreceptor is suppressed.

Furthermore, particularly in the case where an aluminum substrate is used as the conductive substrate, the presence of the compound represented by General Formula (2) in the photosensitive layer suppresses the corrosion of the aluminum substrate due to the electron-transporting material represented by General Formula (1).

The electrophotographic photoreceptor of the exemplary embodiment will now be described in detail with reference to the drawing.

FIG. 1 is a schematic cross-sectional view illustrating part of an electrophotographic photoreceptor 10 according to the exemplary embodiment.

The electrophotographic photoreceptor 10 illustrated in FIG. 1 includes, for example, a conductive substrate 4, an undercoat layer 1, a single-layered photosensitive layer 2, and a protective layer 3; and these layers overlie the conductive substrate 4 in sequence.

The undercoat layer 1 and the protective layer 3 are optionally formed. In other words, the single-layered photosensitive layer 2 can be formed directly on the conductive substrate 4 or formed with the undercoat layer 1 interposed therebetween. The protective layer 3 need not be formed where appropriate.

Each layer of the electrophotographic photoreceptor of the exemplary embodiment will now be described in detail. The reference symbols thereof are omitted in the description.

Conductive Substrate

Examples of the conductive substrate include metal plates, metal drums, and metal belts containing metals (such as aluminum, copper, zinc, chromium, nickel, molybdenum, vanadium, indium, gold, and platinum) or alloys (such as stainless steel). Other examples of the conductive substrate include paper, resin films, and belts each having a coating film formed by applying, depositing, or laminating conductive compounds (such as conductive polymers and indium oxide), metals (such as aluminum, palladium, and gold), or alloys. The term "conductive" herein refers to having a volume resistivity that is less than $10^{13}$ Ωcm.

In the case where the electrophotographic photoreceptor is used in a laser printer, the surface of the conductive substrate may be roughened at a center-line average roughness (Ra) ranging from 0.04 μm to 0.5 μm in order to reduce an interference fringe generated in radiation of laser light. In the case where an incoherent light source is used, the surface of the conductive substrate need not be roughened to reduce an interference fringe; such an incoherent light source can reduce the occurrence of defects due to uneven surface of the conductive substrate and is therefore more suitable for prolonging a product lifetime.

Examples of a technique for roughening the surface include wet honing in which an abrasive suspended in water is sprayed to a substrate, centerless grinding in which continuous grinding is carried out by pressing the conductive substrate against a rotating grindstone, and anodizing.

The surface may be roughened, for instance, by another technique in which the surface of the conductive substrate is not directly roughened; in particular, conductive or semiconductive powder is dispersed in resin, the resin is applied onto the surface of the conductive substrate into a layer, and the particles dispersed in the formed layer impart roughness.

In a process for roughening the surface by anodizing, a conductive substrate formed of metal (e.g., aluminum) serves as the anode in an electrolyte solution and is anodized to form an oxide film on the surface of the conductive substrate. Examples of the electrolyte solution include a sulphuric acid solution and an oxalic acid solution. A porous anodized film formed by anodizing is, however, chemically active in its natural state; thus, such an anodized film is easily contaminated, and its resistance greatly varies depending on environment. Accordingly, a process for closing the pores of the porous anodized film can be carried out; in such a process, the pores are closed by volume expansion due to a hydration reaction in steam under pressure or in boiled water (metal salt such as nickel is optionally added), and the porous anodized film is converted into more stable hydrous oxide.

The thickness of the anodized film can be, for example, in the range of 0.3 μm to 15 μm. A thickness within this range is likely to give a barrier property for implantation and tends to suppress an increase in residual potential due to continued use of the electrophotographic photoreceptor.

The conductive substrate may be subjected to a treatment with an acidic solution or a boehmite treatment.

The treatment with an acidic solution is carried out, for example, as follows. An acidic solution containing phosphoric acid, chromic acid, and hydrofluoric acid is prepared. In the acidic solution, for instance, the amount of the phosphoric acid is in the range of 10 weight % to 11 weight %, the amount of the chromic acid is in the range of 3 weight % to 5 weight %, and the amount of the hydrofluoric acid is in the range of 0.5 weight % to 2 weight %; the total concentration of these acids can be in the range of 13.5 weight % to 18 weight %. The temperature in the treatment can be, for example, from 42° C. to 48° C. The thickness of the coating film can be from 0.3 μm to 15 μm.

In the boehmite treatment, for example, the conductive substrate is immersed into pure water at a temperature from 90° C. to 100° C. from 5 minutes to 60 minutes or brought into contact with heated steam at a temperature from 90° C. to 120° C. from 5 minutes to 60 minutes. The thickness of the coating film can be from 0.1 μm to 5 μm. The resulting product may be optionally anodized with an electrolyte solution which less dissolves the coating film, such as adipic acid, boric acid, borate, phosphate, phthalate, maleate, benzoate, tartrate, or citrate.

Undercoat Layer

The undercoat layer contains, for example, inorganic particles and a binder resin.

Examples of the inorganic particles include inorganic particles having a powder resistivity (volume resistivity) that is in the range of $10^2$ Ωcm to $10^{11}$ Ωcm.

In particular, examples of the inorganic particles having such a resistance value include metal oxide particles such as tin oxide particles, titanium oxide particles, zinc oxide particles, and zirconium oxide particles; of these, zinc oxide particles can be employed.

The specific surface area of the inorganic particles obtained by a Brunauer, Emmett, and Teller (BET) method can be, for instance, not less than 10 $m^2/g$.

The volume average particle size of the inorganic particles can be, for example, in the range of 50 nm to 2000 nm (particularly from 60 nm to 1000 nm).

The amount of the inorganic particles is, for example, preferably in the range of 10 weight % to 80 weight %, and more preferably 40 weight % to 80 weight % relative to the amount of the binder resin.

The inorganic particles may be subjected to surface treatment. Two or more different types of inorganic particles which have been subjected to different surface treatments or which have different particle sizes may be used in combination.

Examples of a surface-treating agent include a silane coupling agent, a titanate-based coupling agent, an aluminum-based coupling agent, and a surfactant. Among these, a silane coupling agent can be employed; in particular, a silane coupling agent having an amino group can be used.

Examples of the silane coupling agent having an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used in combination. For instance, the silane coupling agent having an amino group can be used in combination with another silane coupling agent. Examples of such a silane coupling agent additionally used include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment with a surface-treating agent can be carried out by any known technique; either a dry process or a wet process can be employed.

The amount of the surface-treating agent can be, for instance, in the range of 0.5 weight % to 10 weight % relative to the amount of the inorganic particles.

The undercoat layer can contain an electron-accepting compound (acceptor compound) in addition to the inorganic particles in terms of the long-term stability of electrical properties and an enhancement in carrier-blocking properties.

Examples of the electron-accepting compound include electron-transporting substances, such as quinone compounds (e.g., chloranil and bromanil); tetracyanoquinodimethane compounds; fluorenone compounds (e.g., 2,4,7-trinitrofluorenone and 2,4,5,7-tetranitro-9-fluorenone); oxadiazole compounds [e.g., 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4 oxadiazole]; xanthone compounds; thiophene compounds; and diphenoquinone compounds (e.g., 3,3',5,5'tetra-t-butyldiphenoquinone).

In particular, compounds having an anthraquinone structure can be employed as the electron-accepting compound. Examples of the compounds having an anthraquinone structure include hydroxyanthraquinone compounds, aminoanthraquinone compounds, and aminohydroxyanthraquinone compounds. Specific examples thereof include anthraquinone, alizarin, quinizarin, anthrarufin, and purpurin.

In the undercoat layer, the electron-accepting compound may be dispersed together with the inorganic particles or may adhere to the surfaces of the inorganic particles.

The electron-accepting compound is allowed to adhere to the surfaces of the inorganic particles by, for instance, a dry process or a wet process.

In the dry process, for example, the electron-accepting compound is allowed to adhere to the surfaces of the inorganic particles as follows: the inorganic particles are stirred in a mixer which can apply large shear force, and in this state, the electron-accepting compound alone or a solution in which the electron-accepting compound has been dissolved in an organic solvent is dropped or sprayed along with dried air or nitrogen gas. The electron-accepting compound can be dropped or sprayed at a temperature less than or equal to the boiling point of the solvent. After the dropping or spraying of the electron-accepting compound, a heating process may be carried out at not less than 100° C. The heating process can be performed at any temperature for any length of time provided that electrophotographic properties can be developed.

In the wet process, for instance, the electron-accepting compound is allowed to adhere to the surfaces of the inorganic particles as follows: the inorganic particles are dispersed in a solvent by a technique involving stirring, ultrasonic wave, a sand mill, an attritor, or a ball mill; in this state, the electron-accepting compound is added thereto and then stirred or dispersed; and the solvent is subsequently removed. The solvent is removed through, for instance, being filtered or distilled off by distillation. After the removal of the solvent, a heating process may be carried out at not less than 100° C. The heating process can be performed at any temperature for any length of time provided that electrophotographic properties can be developed. In the wet process, the moisture content in the inorganic particles may be removed in advance of the addition of the electron-accepting compound; for example, the moisture content is removed by being stirred in a solvent under heating or by being azeotroped with a solvent.

The electron-accepting compound may be allowed to adhere before or after the surface treatment of the inorganic particles with a surface-treating agent; the adhesion of the electron-accepting compound and the surface treatment with the surface-treating agent may be simultaneously carried out.

The amount of the electron-accepting compound can be, for instance, in the range of 0.01 weight % to 20 weight %, and particularly 0.01 weight % to 10 weight % relative to the amount of the inorganic particles.

Examples of the binder resin used in the undercoat layer include known high molecular compounds such as acetal resins (e.g., polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and known materials such as silane coupling agents.

Other examples of the binder resin used in the undercoat layer include electron-transporting resins having electron-transporting groups and conductive resins (such as polyaniline).

Among these, a resin that is insoluble in a solvent used in a coating solution for forming the upper layer is suitable for the binder resin used in the undercoat layer. In particular, such a suitable resin can be obtained by a reaction of a curing agent with at least one resin selected from the group consisting of thermosetting resins such as urea resins, phenolic resins, phenol-formaldehyde resins, melamine resins, urethane resins, unsaturated polyester resins, alkyd resins, and epoxy resins; polyamide resins; polyester resins; polyether resins; methacrylic resins; acrylic resins; polyvinyl alcohol resins; and polyvinyl acetal resins.

In the case where such binder resins are used in combination, the combination ratio is appropriately determined.

The undercoat layer can contain a variety of additives in order to improve electrical properties, environmental stability, and image quality.

Examples of the additives include electron-transporting pigments, such as condensed polycyclic pigments and azo pigments, and known materials such as zirconium chelate compounds, titanium chelate compounds, aluminum chelate compounds, titanium alkoxide compounds, organic titanium compounds, and silane coupling agents. A silane coupling agent is used for the surface treatment of the inorganic particles as described above and may be further added as an additive to the undercoat layer.

Examples of the silane coupling agent used as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimers, tetra(2-ethylhexyl)titanate, titanium acetylacetonate, polytitanium acetylacetonate, titanium octyleneglycolate, titanium lactate ammonium salts, titanium lactate, titanium lactate ethyl esters, titanium triethanolaminate, and polyhydroxytitanium stearate.

Examples of the aluminum chelate compounds include aluminum isopropylate, monobutoxyaluminum diisopropylate, aluminum butylate, diethyl acetoacetate aluminum diisopropylate, and aluminum tris(ethyl acetoacetate).

These additives may be used alone or in the form of a mixture or a polycondensate of multiple kinds.

The undercoat layer can have a Vickers hardness of not less than 35.

In order to reduce a moire fringe, the surface roughness (ten-point average roughness) of the undercoat layer can be adjusted to be from ¼n (n represents the refractive index of the upper layer) to ½λ of the wavelength λ of laser light to be used for exposure.

In order to adjust the surface roughness, for example, resin particles may be added to the undercoat layer. Examples of the resin particles include silicone resin particles and cross-linked polymethylmethacrylate resin particles. Furthermore, the undercoat layer may be polished to adjust the surface roughness. Examples of a polishing technique include buffing, sand blasting, wet honing, and grinding.

The undercoat layer can be formed by any known technique; for example, a coating solution for forming the undercoat layer is prepared by adding the above-mentioned components to a solvent, a coating film of the coating solution is formed, and the coating film is dried and optionally heated.

Examples of the solvent used in the preparation of the coating solution for forming the undercoat layer include known organic solvents such as alcohol solvents, aromatic hydrocarbon solvents, halogenated hydrocarbon solvents, ketone solvents, ketone alcohol solvents, ether solvents, and ester solvents.

Specific examples thereof include common organic solvents such as methanol, ethanol, n-propanol, isopropyl alcohol, n-butanol, benzylalcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a technique for dispersing the inorganic particles in the preparation of the coating solution for forming the undercoat layer include known techniques which involve using a roll mill, a ball mill, a vibratory ball mill, an attritor, a sand mill, a colloid mill, or a paint shaker.

Examples of a technique for applying the coating solution for forming the undercoat layer to the conductive substrate include common techniques such as blade coating, wire-bar coating, spray coating, dip coating, bead coating, air knife coating, and curtain coating.

The thickness of the undercoat layer is, for example, preferably not less than 15 μm, and more preferably in the range of 20 μm to 50 μm.

Intermediate Layer

An intermediate layer (not illustrated) may be additionally formed between the undercoat layer and the photosensitive layer.

An example of the intermediate layer is a layer containing resin. Examples of the resin used in the intermediate layer include known polymers such as acetal resins (e.g., polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer containing an organometallic compound. Examples of such an organometallic compound used in the intermediate layer include organometallic compounds containing a metal atom such as a zirconium atom, a titanium atom, an aluminum atom, a manganese atom, or a silicon atom.

These compounds used in the intermediate layer may be used alone or in the form of a mixture or a polycondensate of multiple kinds.

In particular, the intermediate layer can be a layer containing an organometallic compound containing a zirconium atom or a silicon atom.

The intermediate layer can be formed by any known technique; for example, a coating solution for forming the intermediate layer is prepared by adding the above-mentioned component to a solvent, a coating film of the coating solution is formed, and the coating film is dried and optionally heated.

Examples of a technique for applying the coating solution for forming the intermediate layer include common techniques such as dip coating, extrusion coating, wire-bar coating, spray coating, blade coating, knife coating, and curtain coating.

The thickness of the intermediate layer can be, for example, in the range of 0.1 μm to 3 μm. The intermediate layer may serve as the undercoat layer.

Single-Layered Photosensitive Layer

The single-layered photosensitive layer contains a binder resin, a charge-generating material, a hole-transporting material, the electron-transporting material, the above-mentioned specific compound, and optionally an additive.

Binder Resin

Examples of the binder resin include, but are not limited to, polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinylcarbazole, and polysilane. These binder resins may be used alone or in combination.

Among those binder resins, polycarbonate resins and polyarylate resins can be particularly employed in terms of compatibility with the specific compound which will be described later.

In particular, for instance, the binder resin can be a polycarbonate resin having a viscosity average molecular weight of 30000 to 80000 or a polyarylate resin having a viscosity average molecular weight of 30000 to 80000 in view of formation of the photosensitive layer.

The viscosity average molecular weight can be specifically measured in the following manner. In 100 $cm^3$ of methylene chloride, 1 g of resin is dissolved; then, the specific viscosity ηsp thereof is measured with an Ubbelohde viscometer at 25° C. The limiting viscosity $[\eta](cm^3/g)$ is determined from the relational expression $\eta sp/c=[\eta]+0.45\ [\eta]^2c$ [where c represents concentration (g/cm$^3$)]. Then, the viscosity average molecular weight Mv is determined from the relational expression $[\eta]=1.23\times10^{-4}$ Mv 0.83 given by H. Schnell. This single-point determination is employed.

The amount of the binder resin can be, for instance, in the range of 35 weight % to 60 weight %, desirably 20 weight % to 35 weight % relative to the total solid content in the photosensitive layer.

Charge-Generating Material

Examples of the charge-generating material include azo pigments such as bisazo pigments and trisazo pigments, condensed ring aromatic pigments such as dibromoanthanthrone, perylene pigments, pyrrolopyrrole pigments, phthalocyanine pigments, zinc oxide, and trigonal selenium.

Among these, in view of adaptability to exposure to laser light having a wavelength that is in the near-infrared region, metal phthalocyanine pigments or metal-free phthalocyanine pigments can be used as the charge-generating material. In particular, for example, more suitable materials are hydroxygallium phthalocyanines disclosed in Japanese Unexamined Patent Application Publication Nos. 5-263007 and 5-279591, chlorogallium phthalocyanine disclosed in Japanese Unexamined Patent Application Publication No. 5-98181, dichlorotin phthalocyanines disclosed in Japanese Unexamined Patent Application Publication Nos. 5-140472 and 5-140473, and titanyl phthalocyanine disclosed in Japanese Unexamined Patent Application Publication No. 4-189873.

In view of adaptability to exposure to laser light having a wavelength that is in the near-ultraviolet region, for example, the charge-generating material can be condensed ring aromatic pigments such as dibromoanthanthrone, thioindigo pigments, porphyrazine compounds, zinc oxide, trigonal selenium, or bisazo pigments disclosed in Japanese Unexamined Patent Application Publication Nos. 2004-78147 and 2005-181992.

The charge-generating material is desirably, for example, an inorganic pigment in the case where a light source of which the exposure wavelength is from 380 nm to 500 nm is used or a metal phthalocyanine pigment or metal-free phthalocyanine pigment in the case where a light source of which the exposure wavelength is from 700 nm to 800 nm is used.

In the exemplary embodiment, at least one material selected from hydroxygallium phthalocyanine pigments and chlorogallium phthalocyanine pigments is desirably used as the charge-generating material.

These pigments, as the charge-generating material, may be used alone or in combination where appropriate. Hydroxygallium phthalocyanine pigment can be employed as the charge-generating material in terms of enhancing the sensitivity of the photoreceptor and reducing point defects caused in an image.

The hydroxygallium phthalocyanine pigments are not particularly limited, but a V-type hydroxygallium phthalocyanine pigment can be used.

In particular, for instance, a hydroxygallium phthalocyanine pigment having a maximum peak wavelength within the range of 810 nm to 839 nm in an optical absorption spectrum at a wavelength ranging from 600 nm to 900 nm is desirable in terms of obtaining superior dispersibility. When such a hydroxygallium phthalocyanine pigment is used as a material of the electrophotographic photoreceptor, excellent dispersibility, sufficient sensitivity, a charging property, and dark decay characteristics are easily obtained.

In addition, in the hydroxygallium phthalocyanine pigment having a maximum peak wavelength within the range of 810 nm to 839 nm, it is desirable that the average particle size be within a specific range and that the specific surface area obtained by the BET method be within a specific range. Specifically, the average particle size is desirably not more than 0.20 μm, and more desirably from 0.01 μm to 0.15 μm. The specific surface area obtained by the BET method is desirably not less than 45 m$^2$/g, more desirably not less than 50 m$^2$/g, and especially desirably from 55 m$^2$/g to 120 m$^2$/g. The average particle size is a volume average particle size (d50 average particle size) measured with a laser diffraction/scattering particle size distribution analyzer (LA-700, manufactured by HORIBA, Ltd.). The specific surface area based on the BET method is measured with a BET specific surface area analyzer (FlowSorb II 2300, manufactured by SHIMADZU CORPORATION) under nitrogen purge.

In the case where the average particle size is greater than 0.20 μm or where the specific surface area is less than 45 m$^2$/g, pigment particles are coarsened or agglomerated in some cases. Hence, problems with characteristics such as dispersibility, sensitivity, a charging property, and dark decay characteristics are easily caused in some cases, which may result in readily forming image defects.

The maximum particle size (maximum value of primary particle size) of the hydroxygallium phthalocyanine pigment is desirably not more than 1.2 μm, more desirably not more than 1.0 μm, and further desirably not more than 0.3 μm. If the maximum particle size is above such a range, dark spots are likely to be generated.

The average particle size, maximum particle size, and specific surface are of the hydroxygallium phthalocyanine pigment are desirably not more than 0.2 μm, not more than 1.2 μm, and not less than 45 m$^2$/g, respectively, in view of suppressing uneven density caused by the photoreceptor being exposed to, for instance, light emitted from a fluorescent lamp.

The hydroxygallium phthalocyanine pigment is desirably a V-type hydroxygallium phthalocyanine pigment having diffraction peaks at Bragg angles (2θ±0.2°) of at least 7.3°, 16.0°, 24.9°, and 28.0° in an X-ray diffraction spectrum using CuKα characteristic X-rays.

The chlorogallium phthalocyanine pigment is not particularly limited. A chlorogallium phthalocyanine pigment having diffraction peaks at Bragg angles (2θ±0.2°) of 7.4°, 16.6°, 25.5°, and 28.3° is desirable because such a chlorogallium phthalocyanine pigment is an electrophotographic photosensitive material having an excellent sensitivity.

The desirable maximum peak wavelength of the chlorogallium phthalocyanine pigment in an optical absorption spectrum and the desirable average particle size, maximum particle size, and specific surface area thereof are the same as those of the hydroxygallium phthalocyanine pigment.

The amount of the charge-generating material can be in the range of 1 weight % to 5 weight %, and desirably 1.2 weight % to 4.5 weight % relative to the total solid content in the photosensitive layer.

Hole-Transporting Material

Examples of the hole-transporting material include, but are not limited to, compounds such as triarylamine compounds, benzidine compounds, arylalkane compounds, aryl-substituted ethylene compounds, stilbene compounds, anthracene compounds, and hydrazone compounds. These hole-transporting materials are used alone or in combination.

A desirable hole-transporting material is a triarylamine derivative represented by Formula (B-1) or a benzidine derivative represented by Formula (B-2) in view of charge mobility.

(B-1)

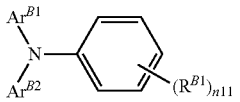

In Formula (B-1), $R^{B1}$ represents a hydrogen atom or a methyl group; n11 represents 1 or 2; and $Ar^{B1}$ and $Ar^{B2}$ each independently represent a substituted or unsubstituted aryl group, $—C_6H_4—C(R^{B3})=C(R^{B4})(R^{B5})$, or $—C_6H_4—CH=CH—CH=C(R^{B6})(R^{B7})$, where $R^{B3}$ to $R^{B7}$ each independently represent a hydrogen atom, a substituted or unsubstituted alkyl group, or a substituted or unsubstituted aryl group. Examples of a substituent include a halogen atom, an alkyl group having 1 to 5 carbon atoms, an alkoxy group having 1 to 5 carbon atoms, and a substituted amino group that has been substituted with an alkyl group having 1 to 3 carbon atoms.

(B-2)

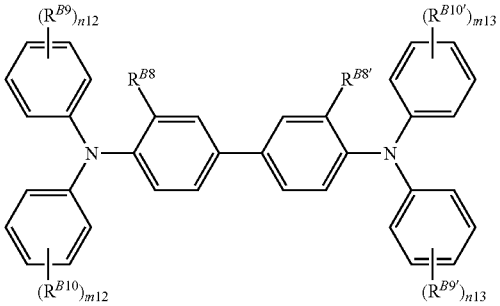

In Formula (B-2), $R^{B8}$ and $R^{B8'}$ may be the same as or different from each other and each independently represent a hydrogen atom, a halogen atom, an alkyl group having 1 to 5 carbon atoms, or an alkoxy group having 1 to 5 carbon atoms; $R^{B9}$, $R^{B9'}$, $R^{B10}$, and $R^{B10'}$ may be the same as or different from each other and each independently represent a hydrogen atom, a halogen atom, an alkyl group having 1 to 5 carbon atoms, an alkoxy group having 1 to 5 carbon atoms, an amino group that has been substituted with an alkyl group having 1 or 2 carbon atoms, a substituted or unsubstituted aryl group, $—C(R^{B11})=C(R^{B12})(R^{B13})$, or $—CH=CH—CH=C(R^{B14})(R^{B15})$, where $R^{B11}$ to $R^{B15}$ each independently represent a hydrogen atom, a substituted or unsubstituted alkyl group, or a substituted or unsubstituted aryl group; and m12, m13, n12, and n13 each independently represent an integer from 0 to 2.

Among triarylamine derivatives represented by Formula (B-1) and benzidine derivatives represented by Formula (B-2), a triarylamine derivative having $—C_6H_4—CH=CH—CH=C(R^{B6})(R^{B7})$ and a benzidine derivative having $—CH=CH—CH=C(R^{B14})(R^{B15})$ are especially desirable.

Specific examples of the triarylamine derivatives represented by Formula (B-1) and the benzidine derivatives represented by Formula (B-2) include the following compounds.

HT-1

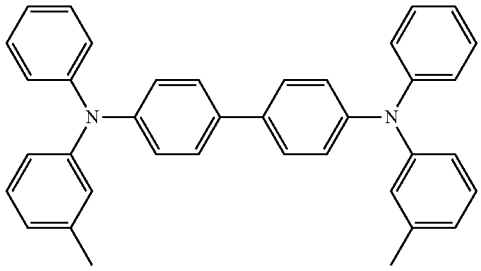

HT-2

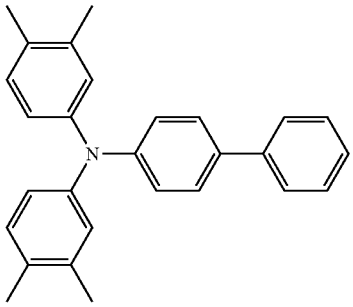

HT-3

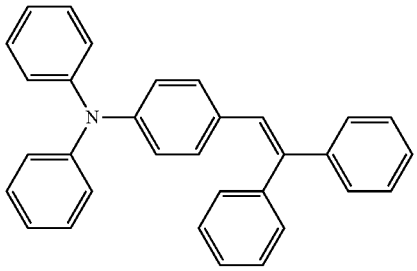

HT-4

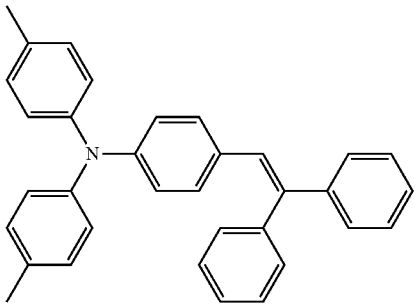

HT-5

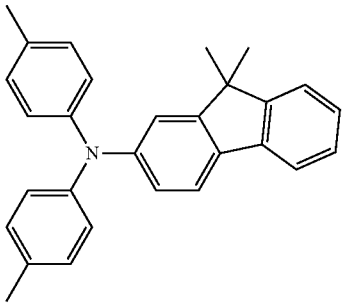

HT-6

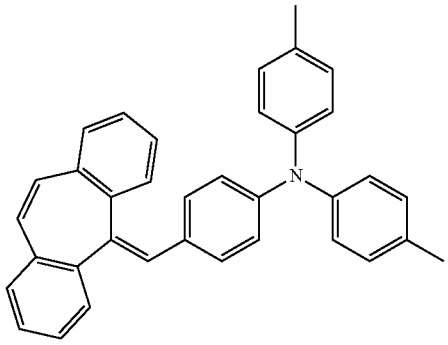

-continued
HT-7
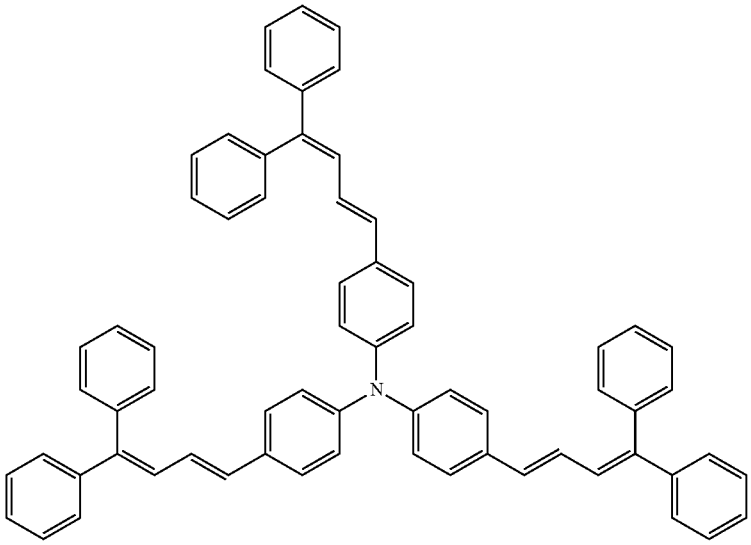
HT-8
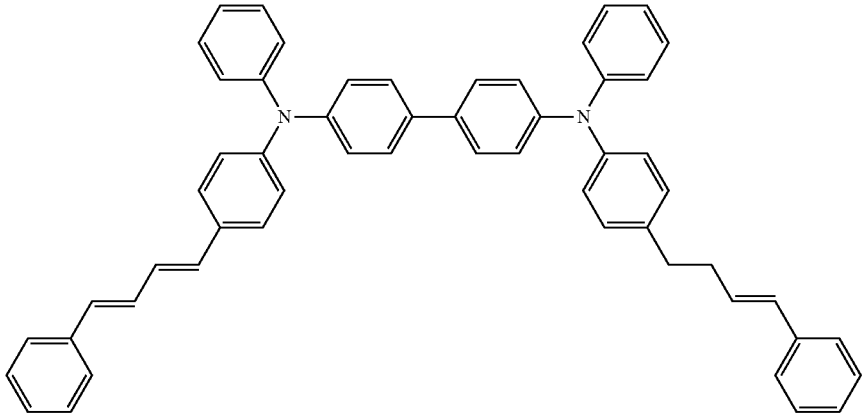
HT-9
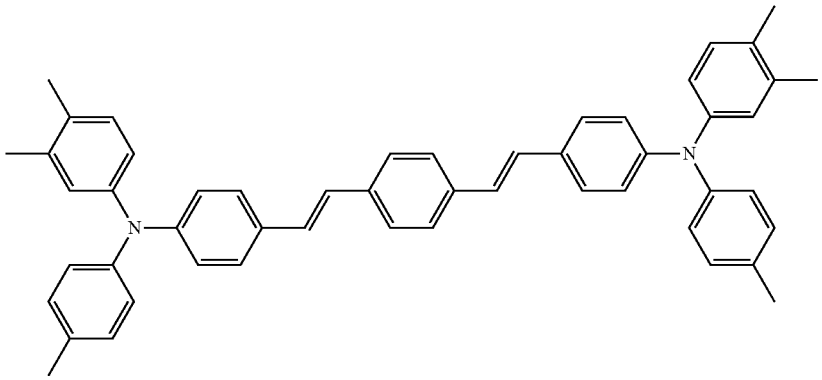
HT-10
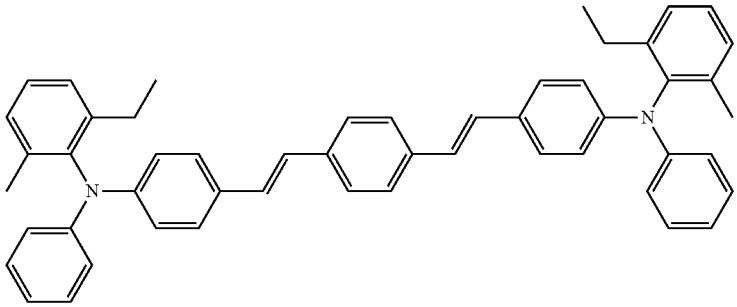

The amount of the hole-transporting material can be in the range of 10 weight % to 40 weight %, and desirably 20 weight % to 35 weight % relative to the total solid content in the photosensitive layer. In the case where multiple hole-transporting materials are used in combination, this amount of the hole-transporting material is the total amount of the hole-transporting materials used.

Electron-Transporting Material

The electron-transporting material to be used is at least an electron-transporting material represented by General Formula (1). The electron-transporting material represented by General Formula (1) can be used in combination with the compound represented by General Formula (2), which is a specific compound described later in detail, as an electron-transporting material because the compound represented by General Formula (2) has a function of transporting electrons (electron-transporting function) as described above. In such a case, the compound represented by General Formula (2) is used within the above-mentioned range of the specific compound content.

When the term "electron-transporting material" is herein simply used, the concept of this term comprehends the compound represented by General Formula (2).

The electron-transporting material represented by General Formula (1) will now be described.

General Formula (1)

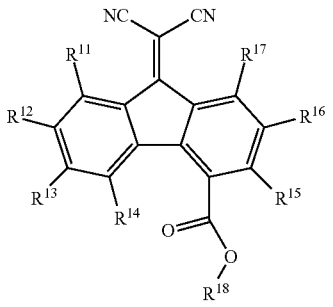

In General Formula (1), $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, an aryl group, or an aralkyl group; and $R^{18}$ represents an alkyl group, $-L^{41}-O-R^{42}$, an aryl group, or an aralkyl group, where $L^{41}$ represents an alkylene group, and $R^{42}$ represents an alkyl group.

Examples of the halogen atom which $R^{11}$ to $R^{17}$ in General Formula (1) each independently represent include a fluorine atom, a chlorine atom, a bromine atom, and an iodine atom.

Examples of the alkyl group which $R^{11}$ to $R^{17}$ in General Formula (1) each independently represent include linear or branched alkyl groups having 1 to 4 carbon atoms (particularly 1 to 3 carbon atoms); specific examples thereof include a methyl group, an ethyl group, an n-propyl group, an isopropyl group, an n-butyl group, and an isobutyl group.

Examples of the alkoxy group which $R^{11}$ to $R^{17}$ in General Formula (1) each independently represent include alkoxy groups having 1 to 4 carbon atoms (particularly 1 to 3 carbon atoms); specific examples thereof include a methoxy group, an ethoxy group, a propoxy group, and a butoxy group.

Examples of the aryl group which $R^{11}$ to $R^{17}$ in General Formula (1) each independently represent include a phenyl group and a tolyl group.

Examples of the aralkyl group which $R^{11}$ to $R^{17}$ in General Formula (1) each independently represent include a benzyl group, a phenethyl group, and a phenylpropyl group.

Among these, a phenyl group is desirable.

Examples of the alkyl group which $R^{18}$ in General Formula (1) represents include linear alkyl groups having 5 to 10 carbon atoms and branched alkyl groups having 5 to 10 carbon atoms.

Examples of the linear alkyl groups having 5 to 10 carbon atoms include a methyl group, an ethyl group, an n-propyl group, an n-butyl group, an n-pentyl group, an n-hexyl group, an n-heptyl group, an n-octyl group, an n-nonyl group, and an n-decyl group.

Examples of the branched alkyl groups having 5 to 10 carbon atoms include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

In the $-L^{41}-O-R^{42}$ group represented by $R^{18}$ in General Formula (1), $L^{41}$ represents an alkylene group, and $R^{42}$ represents an alkyl group.

Examples of the alkylene group represented by $L^{41}$ include linear or branched alkylene groups having 1 to 12 carbon atoms, such as a methylene group, an ethylene group, an n-propylene group, an isopropylene group, an n-butylene group, an isobutylene group, a sec-butylene group, a tert-butylene group, an n-pentylene group, an isopentylene group, a neopentylene group, and a tert-pentylene group.

Examples of the alkyl group represented by $R^{42}$ are the same as the examples of the alkyl group represented by $R^{11}$ to $R^{17}$.

Examples of the aryl group represented by $R^{18}$ in General Formula (1) include a phenyl group, a methylphenyl group, and a dimethylphenyl group.

In the case where $R^{18}$ in General Formula (1) represents an aryl group, any of hydrogen atoms of the aryl group can be substituted with an alkyl group in consideration of solubility. Examples of the alkyl group with which any of hydrogen atoms of the aryl group is substituted are the same as the examples of the alkyl group represented by $R^{11}$ to $R^{17}$. Specific examples of the alkyl-substituted aryl group include a methylphenyl group, a dimethylphenyl group, and an ethylphenyl group.

Examples of the aralkyl group represented by $R^{18}$ in General Formula (1) include groups represented by $-R^{19}-Ar$, where $R^{19}$ represents an alkylene group, and Ar represents an aryl group.

Examples of the alkylene group represented by $R^{19}$ include linear or branched alkylene groups having 1 to 12 carbon atoms, such as a methylene group, an ethylene group, an n-propylene group, an isopropylene group, an n-butylene group, an isobutylene group, a sec-butylene group, a tert-butylene group, an n-pentylene group, an isopentylene group, a neopentylene group, and a tert-pentylene group.

Examples of the aryl group represented by Ar include a phenyl group, a methylphenyl group, a dimethylphenyl group, and an ethylphenyl group.

Specific examples of the aralkyl group represented by $R^{18}$ in General Formula (1) include a benzyl group, a methylbenzyl group, a dimethylbenzyl group, a phenylethyl group, a methylphenylethyl group, a phenylpropyl group, and a phenylbutyl group.

The electron-transporting material represented by General Formula (1) can be, in order to enhance sensitivity and to suppress a reduction in image density, an electron-transporting material in which $R^{18}$ represents a branched alkyl group having 5 to 10 carbon atoms, an aryl group, or an aralkyl group. In particular, an electron-transporting material in which $R^{11}$ to $R^{17}$ each independently represent a hydrogen atom, a halogen atom, or an alkyl group and in which $R^{18}$ represents a branched alkyl group having 5 to 10 carbon atoms, an aryl group, or an aralkyl group can be employed.

Exemplary compounds of the electron-transporting material represented by General Formula (1) are shown below, but the electron-transporting material is not limited thereto. The numbers denoting the following exemplary compounds will be in the form of "Exemplary Compound (1-number)". Specifically, for example, the exemplary compound 15 is referred to as "Exemplary Compound (1-15)".

| Exemplary Compound | $R^{11}$ | $R^{12}$ | $R^{13}$ | $R^{14}$ | $R^{15}$ | $R^{16}$ | $R^{17}$ | $R^{18}$ |
|---|---|---|---|---|---|---|---|---|
| 1 | H | H | H | H | H | H | H | -n—$C_7H_{15}$ |
| 2 | H | H | H | H | H | H | H | -n—$C_8H_{17}$ |
| 3 | H | H | H | H | H | H | H | -n—$C_5H_{11}$ |
| 4 | H | H | H | H | H | H | H | -n—$C_{10}H_{21}$ |
| 5 | Cl | Cl | Cl | Cl | Cl | Cl | Cl | -n—$C_7H_{15}$ |
| 6 | H | Cl | H | Cl | H | Cl | Cl | -n—$C_7H_{15}$ |
| 7 | $CH_3$ | $CH_3$ | $CH_3$ | $CH_3$ | $CH_3$ | $CH_3$ | $CH_3$ | -n—$C_7H_{15}$ |
| 8 | $C_4H_9$ | $C_4H_9$ | $C_4H_9$ | $C_4H_9$ | $C_4H_9$ | $C_4H_9$ | $C_4H_9$ | -n—$C_7H_{15}$ |
| 9 | $CH_3O$ | H | $CH_3O$ | H | $CH_3O$ | H | $CH_3O$ | -n—$C_8H_{17}$ |
| 10 | $C_6H_5$ | $C_6H_5$ | $C_6H_5$ | $C_6H_5$ | $C_6H_5$ | $C_6H_5$ | $C_6H_5$ | -n—$C_8H_{17}$ |
| 11 | H | H | H | H | H | H | H | -n—$C_4H_9$ |
| 12 | H | H | H | H | H | H | H | -n—$C_{11}H_{23}$ |
| 13 | H | H | H | H | H | H | H | -n—$C_9H_{19}$ |
| 14 | H | H | H | H | H | H | H | —$CH_2$—$CH(C_2H_5)$—$C_4H_9$ |
| 15 | H | H | H | H | H | H | H | —$(CH_2)_2$—Ph |
| 16 | H | H | H | H | H | H | H | —$CH_2$—Ph |

In the exemplary compounds, Ph is an abbreviation for a phenyl group.

Another Electron-Transporting Material

In addition to the electron-transporting material represented by General Formula (1) and the compound represented by General Formula (2) which will be described later in detail, another electron-transporting material may be used in combination provided that the function thereof is not impaired. An additional electron-transporting material [electron-transporting material other than the electron-transporting material represented by General Formula (1) and the compound represented by General Formula (2)] can be used in an amount of not more than 10 weight % relative to the total amount of the hole-transporting material and the electron-transporting material [including the compound represented by General Formula (2)].

Examples of the additional electron-transporting material include, but are not limited to, electron-transporting compounds such as quinone compounds (e.g., p-benzoquinone, chloranil, bromanil, and anthraquinone), tetracyanoquinodimethane compounds, fluorenone compounds (e.g., 2,4,7-trinitrofluorenone), xanthone compounds, benzophenone compounds, cyanovinyl compounds, and ethylene compounds. These additional electron-transporting materials may be used alone or in combination.

The amount of the electron-transporting material can be in the range of 5 weight % to 30 weight %, and desirably 10 weight % to 20 weight % relative to the total solid content in the photosensitive layer.

Within this range of the amount of the electron-transporting material relative to the total solid content in the photosensitive layer, the photoreceptor has better electrical properties as compared with the case in which the amount is below the range, and a formed image is less likely to suffer from fogging and a black spot as compares with the case in which the amount is above the range.

In the case where the electron-transporting material represented by General Formula (1) is used in combination with another electron-transporting material [including the compound represented by General Formula (2)], this amount of the electron-transporting material is the total amount of the electron-transporting materials used.

Ratio of Hole-Transporting Material to Electron-Transporting Material

The ratio of the hole-transporting material to the electron-transporting material on a weight basis (hole-transporting material/electron-transporting material) is desirably from 50/50 to 90/10, and more desirably 60/40 to 80/20.

In the case where another electron-transporting material is additionally used, this ratio is calculated using the total amount of the electron-transporting materials used.

Specific Compound

The single-layered photosensitive layer contains the specific compound [at least one compound selected from compounds represented by General Formulae (2) and (3)] as described above.

General Formula (2)

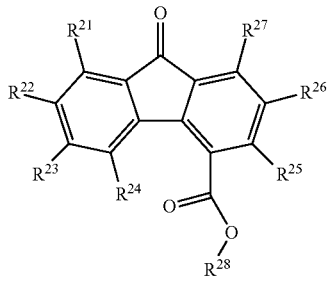

In General Formula (2), $R^{21}$, $R^{22}$, $R^{23}$, $R^{24}$, $R^{25}$, $R^{26}$, and $R^{27}$ each independently represent a hydrogen atom, a halogen atom, an alkyl group, an alkoxy group, an aryl group, or an aralkyl group; and $R^{28}$ represents an alkyl group, -$L^{51}$-O—$R^{52}$, an aryl group, or an aralkyl group, where $L^{51}$ represents an alkylene group, and $R^{52}$ represents an alkyl group.

The detail of $R^{21}$ to $R^{28}$ in General Formula (2) is the same as the above-mentioned detail of $R^{11}$ to $R^{18}$ in General Formula (1). The detail of -$L^{51}$-O—$R^{52}$ represented by $R^{28}$ in General Formula (2) is also the same as that of -$L^{41}$-O—$R^{12}$ represented by $R^{18}$ in General Formula (1).

In the case where the electron-transporting material represented by General Formula (1) and the compound represented by General Formula (2) are used in combination, each of $R^{11}$ to $R^{18}$ in General Formula (1) may be the same as or different from corresponding one of $R^{21}$ to $R^{28}$ in General Formula (2). In order to reduce cracking of the surface of the photoreceptor, a combination of compounds in which each of $R^{11}$ to $R^{18}$ in General Formula (1) is the same as corresponding one of $R^{21}$ to $R^{28}$ in General Formula (2) can be employed.

Exemplary compounds of the compound represented by General Formula (2) are shown below, but the compound is not limited thereto. The numbers denoting the following exemplary compounds will be in the form of "Exemplary Compound (2-number)". Specifically, for example, the exemplary compound 15 is referred to as "Exemplary Compound (2-15)".

| Exemplary Compound | $R^{21}$ | $R^{22}$ | $R^{23}$ | $R^{24}$ | $R^{25}$ | $R^{26}$ | $R^{27}$ | $R^{28}$ |
|---|---|---|---|---|---|---|---|---|
| 1 | H | H | H | H | H | H | H | -n—$C_7H_{15}$ |
| 2 | H | H | H | H | H | H | H | -n—$C_8H_{17}$ |
| 3 | H | H | H | H | H | H | H | -n—$C_5H_{11}$ |
| 4 | H | H | H | H | H | H | H | -n—$C_{10}H_{21}$ |
| 5 | Cl | Cl | Cl | Cl | Cl | Cl | Cl | -n—$C_7H_{15}$ |
| 6 | H | Cl | H | Cl | H | Cl | Cl | -n—$C_7H_{15}$ |
| 7 | $CH_3$ | $CH_3$ | $CH_3$ | $CH_3$ | $CH_3$ | $CH_3$ | $CH_3$ | -n—$C_7H_{15}$ |
| 8 | $C_4H_9$ | $C_4H_9$ | $C_4H_9$ | $C_4H_9$ | $C_4H_9$ | $C_4H_9$ | $C_4H_9$ | -n—$C_7H_{15}$ |
| 9 | $CH_3O$ | H | $CH_3O$ | H | $CH_3O$ | H | $CH_3O$ | -n—$C_8H_{17}$ |
| 10 | $C_6H_5$ | $C_6H_5$ | $C_6H_5$ | $C_6H_5$ | $C_6H_5$ | $C_6H_5$ | $C_6H_5$ | -n—$C_8H_{17}$ |
| 11 | H | H | H | H | H | H | H | -n—$C_4H_9$ |
| 12 | H | H | H | H | H | H | H | -n—$C_{11}H_{23}$ |
| 13 | H | H | H | H | H | H | H | -n—$C_9H_{19}$ |
| 14 | H | H | H | H | H | H | H | —$CH_2$—$CH(C_2H_5)$—$C_4H_9$ |
| 15 | H | H | H | H | H | H | H | —$(CH_2)_2$—Ph |
| 16 | H | H | H | H | H | H | H | —$CH_2$—Ph |

In the exemplary compounds, Ph is an abbreviation for a phenyl group.

The amount of the compound represented by General Formula (2) relative to the total solid content in the photosensitive layer is not particularly limited provided that the amount is within the above-mentioned range of the specific compound content.

The amount of the compound represented by General Formula (2) relative to 100 parts by weight of the electron-transporting material represented by General Formula (1) is also not particularly limited provided that the amount is within the above-mentioned range of the specific compound content.

In order to maintain the electrical properties of the photoreceptor, however, the amount of the compound represented by General Formula (2) relative to 100 parts by weight of the electron-transporting material represented by General Formula (1) is, for example, in the range of approximately 10 parts by weight to 50 parts by weight, and particularly 15 parts by weight to 40 parts by weight.

General Formula (3)

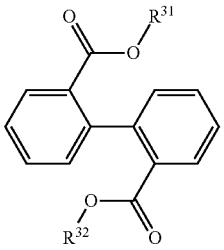

In General Formula (3), $R^{31}$ and $R^{32}$ each independently represent an alkyl group, -$L^{61}$-O—$R^{62}$, an aryl group, or an aralkyl group, where $L^{61}$ represents an alkylene group, and $R^{62}$ represents an alkyl group.

The detail of each of $R^{31}$ and $R^{32}$ in General Formula (3) is the same as the above-mentioned detail of $R^{18}$ in General Formula (1). The detail of -$L^{61}$-O—$R^{62}$ which $R^{31}$ and $R^{32}$ in General Formula (3) each independently represent is also the same as that of -$L^{41}$-O—$R^{42}$ represented by $R^{18}$ in General Formula (1). $R^{31}$ and $R^{32}$ may be the same as or different from each other and can be the same as each other in view of easily carrying out synthesis.

In the case where the compound represented by General Formula (3) is used as the specific compound, each of $R^{31}$ and $R^{32}$ in General Formula (3) may be the same as $R^{28}$ in General Formula (1) which represents the electron-transporting material contained in the photosensitive layer; alternatively, one or both of them may be different from it. In order to reduce cracking of the surface of the photoreceptor, each of $R^{31}$ and $R^{32}$ in General Formula (3) can be the same as $R^{18}$ in General Formula (1).

Exemplary compounds of the compound represented by General Formula (3) are shown below, but the compound is not limited thereto. The numbers denoting the following exemplary compounds will be in the form of "Exemplary Compound (3-number)". Specifically, for example, the Exemplary Compound 8 is referred to as "Exemplary compound (3-8)".

| Exemplary Compound | $R^{31}$ | $R^{32}$ |
|---|---|---|
| 1 | —$CH_3$ | —$CH_3$ |
| 2 | —$C_2H_5$ | —$C_2H_5$ |
| 3 | —$C_3H_7$ | —$C_3H_7$ |
| 4 | -n-$C_4H_9$ | -n-$C_4H_9$ |
| 5 | —$CH_2$—$CH(CH_3)$—$CH_3$ | —$CH_2$—$CH(CH_3)$—$CH_3$ |
| 6 | —$CH_2$—$CH(CH_3)$—$C_4H_9$ | —$CH_2$—$CH(CH_3)$—$C_4H_9$ |
| 7 | —$(CH_2)_2$—Ph | —$(CH_2)_2$—Ph |
| 8 | —$C_2H_5$—O—$CH_3$ | —$C_2H_5$—O—$CH_3$ |

In the exemplary compounds, Ph is an abbreviation for a phenyl group.

The amount of the compound represented by General Formula (3) relative to the total solid content in the photosensitive layer is not particularly limited provided that the amount is within the above-mentioned range of the specific compound content.

The amount of the compound represented by General Formula (3) relative to 100 parts by weight of the electron-transporting material represented by General Formula (1) is also not particularly limited provided that the amount is within the above-mentioned range of the specific compound content. The amount is, for example, in the range of approximately 10 parts by weight to 50 parts by weight, and desirably 15 parts by weight to 40 parts by weight.

Other Additives

The single-layered photosensitive layer can contain other known additives such as a surfactant, an antioxidant, a light stabilizer, and a thermal stabilizer. In the case where the single-layered photosensitive layer serves as the surface layer, the photosensitive layer can contain, for instance, fluororesin particles or silicone oil.

Formation of Single-Layered Photosensitive Layer

The single-layered photosensitive layer is formed from a coating solution for forming the photosensitive layer; the coating solution is prepared by adding the above-mentioned components to a solvent.

Examples of the solvent include common organic solvents such as aromatic hydrocarbons (e.g., benzene, toluene, xylene, and chlorobenzene); ketones (e.g., acetone and 2-butanone); halogenated aliphatic hydrocarbons (e.g., methylene chloride, chloroform, and ethylene chloride); and cyclic or linear ethers (e.g., tetrahydrofuran and ethyl ether). These solvents are used alone or in combination.

In a process for dispersing the particles (for example, charge-generating material) in the coating solution for forming the photosensitive layer, a media disperser, such as a ball mill, a vibratory ball mill, an attritor, a sand mill, or a horizontal sand mill, or a media-less disperser such as a stirrer, an ultrasonic disperser, a roll mill, or a high-pressure homogenizer is used. Examples of the high-pressure homogenizer include a collision-type homogenizer in which the coating solution undergoes liquid-liquid collision or liquid-wall collision under high pressure to enter a dispersion state and a passage-type homogenizer in which the coating solution is allowed to pass through a fine flow path under high pressure to enter a dispersion state.

Examples of a technique for applying the coating solution for forming the photosensitive layer onto the undercoat layer include dip coating, extrusion coating, wire-bar coating, spray coating, blade coating, knife coating, and curtain coating.

The thickness of the single-layered photosensitive layer is desirably in the range of 5 μm to 60 μm, more desirably 5 μm to 50 μm, and further desirably 10 μm to 40 μm.

Image Forming Apparatus (Including Process Cartridge)

An image forming apparatus of the exemplary embodiment includes an electrophotographic photoreceptor, a charging unit that serves for charging the surface of the electrophotographic photoreceptor, an electrostatic latent image-forming unit that serves for forming an electrostatic latent image on the charged surface of the electrophotographic photoreceptor, a developing unit that serves for forming a toner image by developing the electrostatic latent image on the surface of the electrophotographic photoreceptor with a developer containing toner, and a transfer unit that serves for transferring the toner image to the surface of a recording medium. This electrophotographic photoreceptor is the above-mentioned electrophotographic photoreceptor of the exemplary embodiment.

The image forming apparatus of the exemplary embodiment can have a structure employed in known image forming apparatuses: for instance, an apparatus including a fixing unit that fixes a toner image transferred to the surface of a recording medium; a direct-transfer-type apparatus in which a toner image formed on the surface of an electrophotographic photoreceptor is directly transferred to a recording medium; an intermediate-transfer-type apparatus which involves first transfer and second transfer, a toner image formed on the surface of the electrophotographic photoreceptor is transferred to the surface of an intermediate transfer body in the first transfer, and the toner image transferred to the surface of the intermediate transfer body is subsequently transferred to the surface of a recording medium in the second transfer; an apparatus including a cleaner that cleans the surface of an electrophotographic photoreceptor which has not been charged yet after transfer of a toner image; an apparatus including a charge neutralizer which neutralizes the charge on the surface of an image carrier by radiating charge-neutralizing light to the surface of the image carrier which has not been charged yet after transfer of a toner image; and an apparatus including an electrophotographic photoreceptor-heating unit which increases the temperature of the electrophotographic photoreceptor to decrease relative temperature.

In the intermediate-transfer-type apparatus, the transfer unit includes, for example, an intermediate transfer body of which a toner image is transferred to the surface, a first transfer unit which serves for first transfer in which the toner image formed on the surface of an image carrier is transferred to the surface of the intermediate transfer body, and a second transfer unit which serves for second transfer in which the toner image transferred to the surface of the intermediate transfer body is transferred to the surface of a recording medium.

The image forming apparatus of the exemplary embodiment can be either of a dry-developing-type image forming apparatus or a wet-developing-type image forming apparatus (liquid developer is used for development).

In the image forming apparatus of the exemplary embodiment, for instance, the part which has the electrophotographic photoreceptor may be in the form of a cartridge that is detachable from the image forming apparatus (process cartridge). An example of a process cartridge desirably employed is a process cartridge including the electrophotographic photoreceptor of the exemplary embodiment. In addition to the electrophotographic photoreceptor, the process cartridge may have, for example, at least one selected from the group consisting of a charging unit, an electrostatic latent image-forming unit, a developing unit, and a transfer unit.

Examples of the image forming apparatus of the exemplary embodiment will now be described, but the image forming apparatus is not limited thereto. The principle parts of the apparatuses illustrated in the drawings are described, and description of the other parts is omitted.

Figure 2:
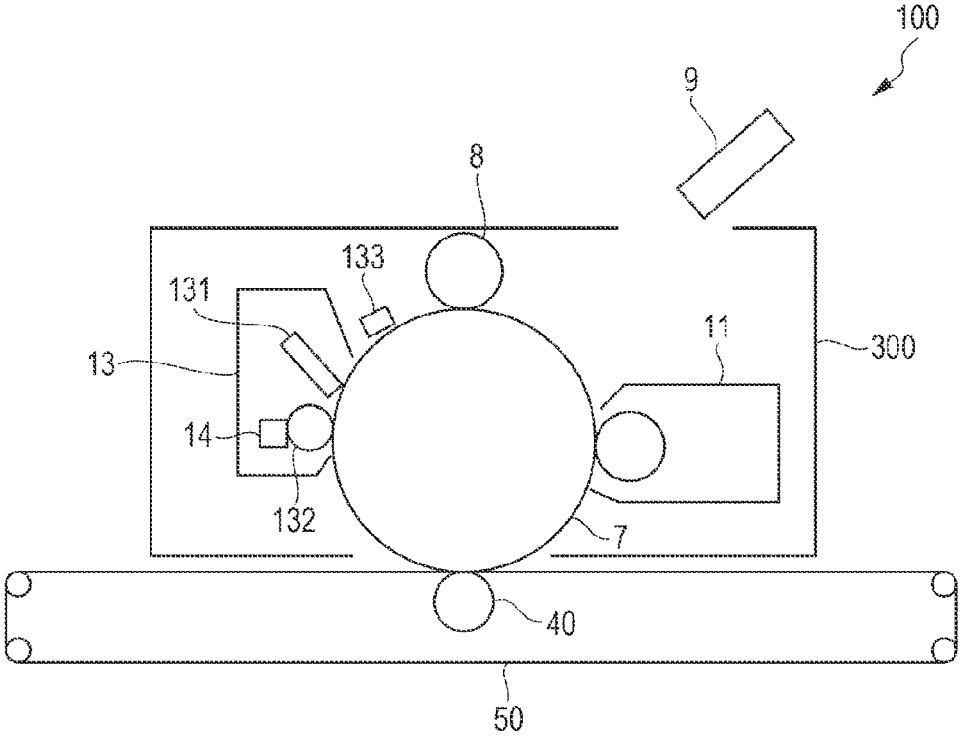
FIG. 2 schematically illustrates the structure of an image forming apparatus according to an exemplary embodiment.

FIG. 2 schematically illustrates an example of the structure of the image forming apparatus according to the exemplary embodiment.

With reference to FIG. 2, an image forming apparatus 100 of the exemplary embodiment includes a process cartridge 300 having an electrophotographic photoreceptor 7, an exposure device 9 (example of the electrostatic latent image-forming unit), a transfer device 40 (first transfer unit), and an intermediate transfer body 50. In the image forming apparatus 100, the exposure device 9 is placed such that light emitted from the exposure device 9 can reach the electrophotographic photoreceptor 7 through an opening of the process cartridge 300 for exposure, the transfer device 40 is disposed so as to face the electrophotographic photoreceptor 7 with the intermediate transfer body 50 interposed therebetween, and the intermediate transfer body 50 is disposed in a state in which part thereof is in contact with the electrophotographic photoreceptor 7. The image forming apparatus 100 also includes a second transfer device (not illustrated) which transfers a toner image transferred to the intermediate transfer body 50 to a recording medium (e.g., paper). Each of the intermediate transfer body 50, transfer device 40 (first transfer unit), and second transfer device (not illustrated) corresponds to an example of the transfer unit.

The process cartridge 300 illustrated in FIG. 2 integrally supports, in its housing, the electrophotographic photoreceptor 7, a charging device 8 (example of the charging unit), a developing device 11 (example of the developing unit), and a cleaning device 13 (example of the cleaner). The cleaning device 13 has a cleaning blade 131 (example of a cleaning member), and the cleaning blade 131 is disposed so as to be in contact with the surface of the electrophotographic photoreceptor 7. The cleaning member may be in a form other than the cleaning blade 131, such as a conductive or insulating fibrous member, and such a cleaning member can be used alone or in combination with the cleaning blade 131.

This example of the structure of the image forming apparatus in FIG. 2 includes a fibrous member 132 (roll) which supplies a lubricant 14 to the surface of the electrophotographic photoreceptor 7 and a fibrous member 133 (flat brush) which supports the cleaning process; these components are optionally provided.

Each component of the image forming apparatus of the exemplary embodiment will now be described.

Charging Device

The charging device 8 is, for example, a contact-type charger using a conductive or semi-conductive charging roller, charging brush, charging film, charging rubber blade, or charging tube. Known chargers can be also used, such as a noncontact-type roller charger or a scorotron or corotron charger utilizing corona discharge.

Exposure Device

Examples of the exposure device 9 include optical devices which emit light, such as light from a semiconductor laser, a light-emitting diode (LED), or a liquid crystal shutter, to the surface of the electrophotographic photoreceptor 7 to exposure the surface thereof to light in a predetermined image pattern. The light source needs to emit light having a wavelength that is within the range of the spectral sensitivity of the electrophotographic photoreceptor. Semiconductor laser light commonly employed has an oscillation wavelength of around 780 nm that is in a near-infrared region. The wavelength is not limited thereto; laser light having an oscillation wavelength of 600 nm or more and less than 700 nm and laser light, as blue laser light, having an oscillation wavelength ranging from 400 nm to 450 nm can be used. Use of a surface-emitting laser light source which can output multiple beams is also effective for forming a color image.

Developing Device

An example of the developing device 11 is a common developing device which develops an image with a developer by contact development or non-contact development. The developing device 11 can have any structure provided that it has such a function, and a proper structure is selected on the basis of the intended purpose. For example, a known developing device having a structure in which a one-component developer or a two-component developer is allowed to adhere to the electrophotographic photoreceptor 7 with a brush or a roller can be used. In particular, a developing device including a developing roller which holds a developer on its surface can be employed.

The developer used in the developing device 11 may be a one-component developer containing toner alone or may be a two-component developer containing toner and a carrier. The developer may be magnetic or non-magnetic. Known developers can be used as such developers.

Cleaning Device

The cleaning device 13 includes the cleaning blade 131; in other words, the cleaning is carried out with the cleaning blade.

Alternatively, instead of cleaning with the cleaning blade, the cleaning may be carried out with a fur brush or may be performed at the same time as the development.

Transfer Device

Examples of the transfer device 40 include known transfer chargers such as contact-type transfer chargers using a belt, a roller, a film, or a rubber blade and scorotron or corotron transfer chargers utilizing corona discharge.

Intermediate Transfer Body

The intermediate transfer body 50 is in the form of a semi-conductive belt (intermediate transfer belt) composed of, for example, polyimide, polyamide imide, polycarbonate, polyarylate, polyester, or rubber. The intermediate transfer body may be also in the form of a drum.

Figure 3:
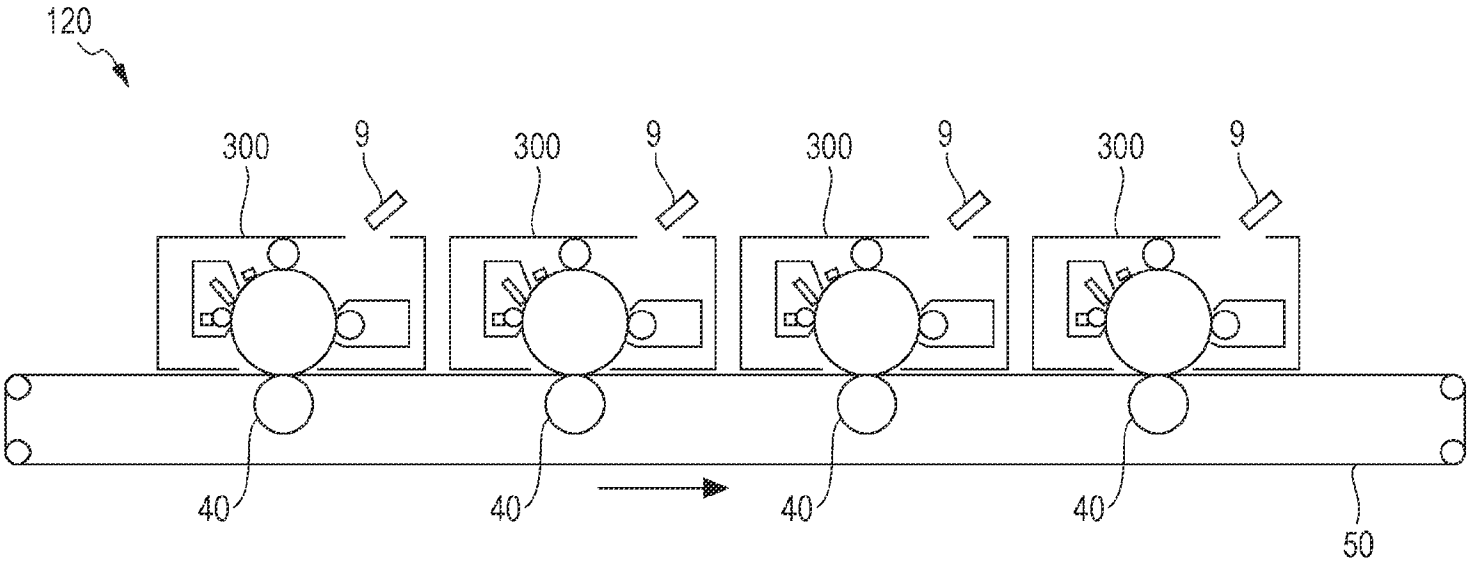
FIG. 3 schematically illustrates the structure of another image forming apparatus according to an exemplary embodiment.

FIG. 3 schematically illustrates another example of the structure of the image forming apparatus according to the exemplary embodiment. An image forming apparatus 120 illustrated in FIG. 3 is a multicolor image forming apparatus of a tandem system in which four process cartridges 300 are used. In the image forming apparatus 120, the four process cartridges 300 are disposed in parallel on the intermediate transfer body 50, and the individual electrophotographic photoreceptors operate for different colors. The image forming apparatus 120 has the same structure as the image forming apparatus 100 except for the tandem system.

The structure of the image forming apparatus 100 of the exemplary embodiment is not limited to the above-mentioned structure. For instance, a first charge-neutralizing device which makes residual toner have the same polarity to easily remove the residual toner with a cleaning brush may be provided around the electrophotographic photoreceptor 7 at a position which is on the downstream side relative to the transfer device 40 and on the upstream side relative to the cleaning device 13 in the rotational direction of the electrophotographic photoreceptor 7. Furthermore, a second charge-neutralizing unit which neutralizes the charge on the surface of the electrophotographic conductor 7 may be provided at a position which is on the downstream side relative to the cleaning device 13 and on the upstream side relative to the charging device 8 in the rotational direction of the electrophotographic photoreceptor 7.

The structure of the image forming apparatus 100 of the exemplary embodiment is not limited to the above-mentioned structure and may have a known structure; for instance, a direct transfer system may be employed, in which a toner image formed on the electrophotographic photoreceptor 7 is directly transferred to a recording medium.

EXAMPLES

The present invention will now be further specifically described on the basis of Examples and Comparative Examples but are not limited thereto.

Example 1

Formation of Undercoat Layer

With 500 parts by weight of tetrahydrofuran, 100 parts by weight of zinc oxide (manufactured by TAYCA CORPORTAION, average particle size: 70 nm, and specific surface area: 15 $m^2/g$) is mixed by stirring. Then, 1.2 parts by weight of a silane coupling agent (KBE502 manufactured by Shin-Etsu Chemical Co., Ltd.) is added thereto, and the resulting mixture is stirred for 2 hours. Then, the tetrahydrofuran is distilled off by vacuum distillation, and the product is heated at 120° C. for 3 hours to obtain zinc oxide subjected to surface treatment with the silane coupling agent.

Then, 110 parts by weight of the zinc oxide subjected to surface treatment with the silane coupling agent is mixed with 500 parts by weight of tetrahydrofuran by stirring, a solution in which 0.7 parts by weight of alizarin has been dissolved in 50 parts by weight of tetrahydrofuran is added to the mixture, and the resulting mixture is stirred at 50° C. for 4 hours. The zinc oxide combined with alizarin is subsequently removed by filtration under reduced pressure and then dried at 65° C. under reduced pressure to produce alizarin-combined zinc oxide.

Into 85 parts by weight of methyl ethyl ketone, 60 parts by weight of the alizarin-combined zinc oxide, 13.5 parts by weight of a curing agent (blocked isocyanate, Sumidur 3175, manufactured by Sumitomo Bayer Urethane Co., Ltd.), and 15 parts by weight of a butyral resin (S-LEC BM-1, manufactured by SEKISUI CHEMICAL CO., LTD.) are dissolved to prepare a solution. Then, 38 pats by weight of this solution is mixed with 30 parts by weight of methyl ethyl ketone, and the mixture is subjected to dispersion for 2 and half hours in a sand mill with glass beads having a diameter of 1 mm to produce a dispersion liquid.

To the dispersion liquid, 0.005 parts by weight of dioctyltin dilaurate that serves as a catalyst and 40 parts by weight of silicone resin particles (Tospearl 145, manufactured by GE Toshiba Silicones Co., Ltd.) are added to produce a coating solution for forming an undercoat layer.

The coating solution is applied to an aluminum substrate having a diameter of 30 mm, a length of 340 mm, and a thickness of 1 mm by dip coating and then cured by drying at 170° C. for 40 minutes to form an undercoat layer having a thickness of 21 μm.

Formation of Photosensitive Layer

A mixture of 2 parts by weight of a hydroxygallium phthalocyanine pigment shown in Table 1 as a charge-generating material, 49 parts by weight of polycarbonate Z resin as a binder resin (manufactured by MITSUBISHI GAS CHEMICAL COMPANY, INC., viscosity average molecular weight of 40000), and 300 parts by weight of tetrahydrofuran as a solvent is subjected to dispersion for 6 hours in a sand mill with glass beads having a diameter of 1 mm to produce a dispersion liquid.

To the dispersion liquid, a hole-transporting material shown in Table 1, an electron-transporting material represented by General Formula (1) and shown in Table 1, and a specific compound shown in Table 1 [at least one compound selected from compounds represented by General Formulae (2) and (3)] are added in amounts shown in Table 1. Then, 0.001 parts by weight of silicone oil KP340 (manufactured by Shin-Etsu Chemical Co., Ltd.) is added thereto, and the product is stirred over night to produce a coating solution for forming a photosensitive layer.

The coating solution for forming a photosensitive layer is applied onto the undercoat layer on the aluminum substrate by dip coating and then dried at 135° C. for an hour to form a single-layered photosensitive layer having a thickness of 28 μm.

Through these processes, an electrophotographic photoreceptor is completed.

Examples 2 to 14 and Comparative Examples 1 to 3

The following conditions are changed as shown in Table 1: presence or absence of the undercoat layer; type of the charge-generating material used in the preparation of the coating solution for forming a photosensitive layer; and the types and amounts of the hole-transporting material, electron-transporting material represented by General Formula (1), and specific compound [at least one compound selected from compounds represented by General Formulae (2) and (3)] also used in the preparation of the coating solution for forming a photosensitive layer. Except for such changes, electrophotographic photoreceptors are produced as in Example 1. In Table 1, the term "Amount" refers to an additive amount (parts by weight), and the symbol "-" refers to nonuse of a material. Furthermore, the term "Specific Compound Content" refers to the total amount of compounds represented by General Formulae (2) and (3) relative to 100 parts by weight of an electron-transporting material represented by General Formula (1).

TABLE 1

| Photoreceptor | Undercoat Layer | Charge-Generating Material | Hole-Transporting Material | | General Formula (1) | | General Formula (2) | | General Formula (3) | | Specific Compound Content (parts by weight) |
|---|---|---|---|---|---|---|---|---|---|---|---|
| | | | Type | Amount | Type | Amount | Type | Amount | Type | Amount | |
| Photoreceptor 1 | Presence | Hydroxygallium Phthalocyanine | HT-1 | 32 | 1-2 | 12 | 2-2 | 4 | — | — | 33 |
| Photoreceptor 2 | Absence | Hydroxygallium Phthalocyanine | HT-1 | 32 | 1-2 | 13 | 2-6 | 2 | — | — | 15 |
| Photoreceptor 3 | Presence | Hydroxygallium Phthalocyanine | HT-4 | 32 | 1-6 | 12 | 2-2 | 3.6 | — | — | 30 |
| Photoreceptor 4 | Absence | Hydroxygallium Phthalocyanine | HT-4 | 32 | 1-6 | 10 | 2-6 | 4 | — | — | 40 |
| Photoreceptor 5 | Absence | Chlorogallium Phthalocyanine | HT-1 | 30 | 1-2 | 8 | 2-2 | 3.6 | — | — | 45 |
| Photoreceptor 6 | Absence | Chlorogallium Phthalocyanine | HT-1 | 35 | 1-15 | 10 | 2-6 | 4 | 3-4 | 0.5 | 45 |
| Photoreceptor 7 | Absence | Chlorogallium Phthalocyanine | HT-7 | 35 | 1-14 | 12 | 2-2 | 3 | 3-5 | 0.6 | 30 |
| Photoreceptor 8 | Absence | Chlorogallium Phthalocyanine | HT-7 | 35 | 1-14 | 14 | 2-6 | 8 | 3-5 | 0.4 | 60 |
| Photoreceptor 9 | Absence | X-Type Metal-Free Phthalocyanine | HT-1 | 36 | 1-2 | 12 | 2-2 | 2 | 3-4 | 0.8 | 23 |

TABLE 1-continued

| Photoreceptor | Undercoat Layer | Charge-Generating Material | Hole-Transporting Material Type | Hole-Transporting Material Amount | General Formula (1) Type | General Formula (1) Amount | General Formula (2) Type | General Formula (2) Amount | General Formula (3) Type | General Formula (3) Amount | Specific Compound Content (parts by weight) |
|---|---|---|---|---|---|---|---|---|---|---|---|
| Photoreceptor 10 | Absence | X-Type Metal-Free Phthalocyanine | HT-1 | 33 | 1-2 | 10 | 2-15 | 4 | 3-8 | 1 | 50 |
| Comparative Photoreceptor 11 | Presence | Hydroxygallium Phthalocyanine | HT-1 | 32 | 1-2 | 12 | — | — | — | — | 0 |
| Comparative Photoreceptor 12 | Absence | Hydroxygallium Phthalocyanine | HT-1 | 32 | 1-2 | 13 | 2-2 | 0.6 | — | — | 5 |
| Photoreceptor 13 | Absence | Hydroxygallium Phthalocyanine | HT-4 | 33 | 1-6 | 12 | 2-6 | 2 | 3-4 | 0.9 | 24 |
| Photoreceptor 14 | Absence | Chlorogallium Phthalocyanine | HT-1 | 32 | 1-2 | 10 | 2-6 | 7 | 3-4 | 0.5 | 75 |
| Photoreceptor 15 | Absence | X-Type Metal-Free Phthalocyanine | HT-1 | 36 | 1-2 | 12 | 2-2 | 8.5 | 3-5 | 0.8 | 78 |
| Photoreceptor 16 | Absence | Hydroxygallium Phthalocyanine | HT-7 | 32 | 1-15 | 12 | — | — | 3-4 | 4.5 | 38 |
| Comparative Photoreceptor 17 | Absence | Hydroxygallium Phthalocyanine | HT-7 | 32 | 1-15 | 5 | 2-15 | 6 | 3-4 | 1 | 140 |

The details of abbreviations in Table 1 are as follows.

Charge-Generating Material

Hydroxygallium Phthalocyanine: HOGaPC (V type), V-type hydroxygallium phthalocyanine pigment having diffraction peaks at Bragg angles (2θ±0.2°) of at least 7.3°, 16.0°, 24.9°, and 28.0° in an X-ray diffraction spectrum using CuKα characteristic X-rays (maximum peak wavelength in an optical absorption spectrum at a wavelength ranging from 600 nm to 900 nm: 820 nm, average particle size: 0.12 μm, maximum particle size: 0.2 μm, and specific surface area: 60 $m^2/g$)

Chlorogallium Phthalocyanine: ClGaPC, chlorogallium phthalocyanine pigment having diffraction peaks at Bragg angles (2θ±0.2°) of at least 7.4°, 16.6°, 25.5°, and 28.3° in an X-ray diffraction spectrum using CuKα characteristic X-rays (maximum peak wavelength in an optical absorption spectrum at a wavelength ranging from 600 nm to 900 nm: 780 nm, average particle size: 0.15 μm, maximum particle size: 0.2 μm, and specific surface area: 56 $m^2/g$)

X-Type Metal-Free Phthalocyanine: $H_2PC$, metal-free phthalocyanine pigment (phthalocyanine having two hydrogen atoms coordinated to the center of a phthalocyanine skeleton)

Hole-Transporting Material

HT-1: Exemplary compound (HT-1) of benzidine derivatives represented by General Formula (B-2)

HT-4: Exemplary compound (HT-4) of triarylamine derivatives represented by General Formula (B-1)

HT-7: Exemplary compound (HT-7) of triarylamine derivatives represented by General Formula (B-1)

Electron-Transporting Material Represented by General Formula (1)

1-2: Exemplary compound (1-2) of the electron-transporting material represented by General Formula (1)

1-6: Exemplary compound (1-6) of the electron-transporting material represented by General Formula (1)

1-15: Exemplary compound (1-15) of the electron-transporting material represented by General Formula (1)

1-14: Exemplary compound (1-14) of the electron-transporting material represented by General Formula (1)

Compound Represented by General Formula (2)

2-2: Exemplary compound (2-2) of the compound represented by General Formula (2)

2-6: Exemplary compound (2-6) of the compound represented by General Formula (2)

2-15: Exemplary compound (2-15) of the compound represented by General Formula (2)

Compound Represented by General Formula (3)

3-4: Exemplary compound (3-4) of the compound represented by General Formula (3)

3-5: Exemplary compound (3-5) of the compound represented by General Formula (3)

3-8: Exemplary compound (3-8) of the compound represented by General Formula (3)

Evaluations

Each of the electrophotographic photoreceptors is evaluated as follows. Table 2 shows results of the evaluations.

Evaluation of Resistance to Cracking

To the outer surface of a photoreceptor, 0.5 ml of a hexane solution of 1-weight % oleic acid is sprayed, and the photoreceptor is left to stand at room temperature (25° C.) for 2 weeks. Cracking in the surface of the photoreceptor is evaluated on the basis of the following criteria. A microscope used is a digital microscope (model: VHX-700, manufactured by Keyence Corporation), and the observation is carried out at a magnification of 700 times.

A: No problem found in the observation with the microscope (no crack observed)

B: Fine cracks found in the observation with the microscope, but practically no problem (no crack visually observed)

C: Cracks visually observed Evaluation of Initial Image Quality

In order to evaluate the initial image quality (black spot in the initial image), a 50% halftone image is formed with a printer HL5340D (manufactured by BROTHER INDUSTRIES, LTD.) at a room temperature of 28° C. and a humidity of 85%, and the presence or absence of a black spot in the formed image is evaluated on the basis of the following criteria.

A: No black spot (no black spot visually observed)

B: Slight black spots visually observed, but no problem with image quality

C: Many black spots visually observed, practically problematic

Evaluation of Maintainability of Image Quality

Images are formed on 10000 sheets under the same conditions as the evaluation of the initial image quality, and then a 50% halftone image is formed as in the evaluation of the initial image quality. The presence or absence of a black spot is evaluated on the basis of the following criteria.

A: No black spot (no black spot visually observed)

B: Slight black spots visually observed, but no problem with image quality

C: Many black spots visually observed, practically problematic

Evaluation of Resistance to Damage

Images are formed on 10000 sheets under the same conditions as the evaluation of the initial image quality, and then the surface of a photoreceptor is observed with a microscope (digital microscope, model: VHX-700, manufactured by Keyence Corporation) at a magnification of 500 times. Result of the observation is evaluated on the basis of the following criteria.

A: No damage or very minor damage observed on the surface of the photoreceptor

B: Damage clearly observed on the surface of the photoreceptor, but acceptable

C: Damage observed at many parts of the surface of the photoreceptor and some discoloration visually observed, problematic Evaluation of Maintainability of Electrical Properties The above-mentioned image forming apparatus is modified for the purpose of measurement of electric potential. Specifically, a surface potential-measuring probe (manufactured by TREK, INC, model 555P-1) replaces the developing device and is disposed so as to face the electrophotographic photoreceptor, and the probe is connected to a surface electrometer (manufactured by TREK, INC, Trek 334) to measure electric potential. Then, in printing at solid density, the surface potential of the photoreceptor (surface potential of the photoreceptor on which a latent image at solid density has been formed with the exposure unit) is measured at a room temperature of 28° C. and a humidity of 85%, and the obtained surface potential is determined as post-exposure potential VL.

Such measurement of post-exposure potential VL is carried out before and after formation of 50% halftone images on 10000 sheets, and the difference ΔVL between the obtained potentials is determined and evaluated on the basis of the following criteria.

A: $\Delta VL \leq 15V$

B: $15\ V < \Delta VL \leq 25V$

C: $25\ V < \Delta VL$

TABLE 2

| Example | Photoreceptor | Resistance to Cracking | Black Spots in Initial Image | Maintainability of Image Quality | Resistance to Damage | Maintainability of Electrical Properties |
|---|---|---|---|---|---|---|
| Example 1 | Photoreceptor 1 | A | A | A | B | A |
| Example 2 | Photoreceptor 2 | A | A | A | B | A |
| Example 3 | Photoreceptor 3 | A | A | A | B | A |
| Example 4 | Photoreceptor 4 | A | A | A | B | A |
| Example 5 | Photoreceptor 5 | A | A | A | B | A |
| Example 6 | Photoreceptor 6 | A | A | A | A | A |
| Example 7 | Photoreceptor 7 | A | A | A | A | A |
| Example 8 | Photoreceptor 8 | A | A | A | A | A |
| Example 9 | Photoreceptor 9 | A | A | A | A | A |
| Example 10 | Photoreceptor 10 | A | A | A | A | A |
| Comparative Example 1 | Comparative Photoreceptor 11 | C | C | C | C | C |
| Comparative Example 2 | Comparative Photoreceptor 12 | C | B | C | C | C |
| Example 11 | Photoreceptor 13 | B | B | B | B | B |
| Example 12 | Photoreceptor 14 | B | B | B | B | B |
| Example 13 | Photoreceptor 15 | B | B | B | B | B |
| Example 14 | Photoreceptor 16 | B | B | B | B | B |
| Comparative Example 3 | Comparative Photoreceptor 17 | C | B | C | C | C |

The results of the evaluations show that resistance to cracking is better in Examples than in Comparative Examples; in other words, cracking of the surface of a photoreceptor is suppressed in each of Examples.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate; and a single-layered photosensitive layer formed so as to overlie the conductive substrate, the photosensitive layer containing a binder resin, a charge-generating material, a hole-transporting material, an electron-transporting material represented by Formula (1), a compound represented by Formula (2), and a compound represented by Formula (3), wherein the amount of the compound represented by Formula (2) and the compound represented by Formula (3) is in the range of approximately 10 parts by weight to 100 parts by weight in total relative to 100 parts by weight of the electron-transporting material represented by Formula (1), Formula (1)

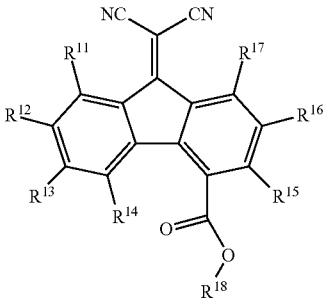

where $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, an aryl group, or an aralkyl group; and $R^{18}$ represents an alkyl group, $-L^{41}-O-R^{42}$, an aryl group, or an aralkyl group, where $L^{41}$ represents an alkylene group, and $R^{42}$ represents an alkyl group, Formula (2)

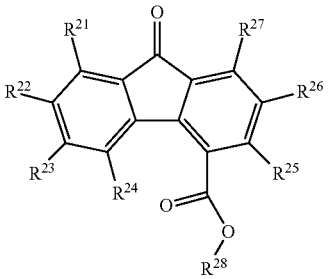

where $R^{21}$, $R^{22}$, $R^{23}$, $R^{24}$, $R^{25}$, $R^{26}$, and $R^{27}$ each independently represent a hydrogen atom, a halogen atom, an alkyl group, an alkoxy group, an aryl group, or an aralkyl group; and $R^{28}$ represents an alkyl group, $-L^{51}-O-R^{52}$, an aryl group, or an aralkyl group, where $L^{51}$ represents an alkylene group, and $R^{52}$ represents an alkyl group, and Formula (3)

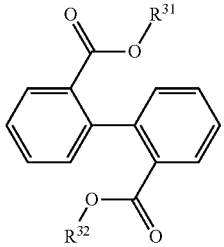

where $R^{31}$ and $R^{32}$ each independently represent an alkyl group, $-L^{61}-O-R^{62}$, an aryl group, or an aralkyl group, where $L^{61}$ represents an alkylene group, and $R^{62}$ represents an alkyl group.

2. The electrophotographic photoreceptor according to claim 1, wherein the amount of the compound represented by Formula (2) and the compound represented by Formula (3) is in the range of approximately 15 parts by weight to 80 parts by weight in total relative to 100 parts by weight of the electron-transporting material represented by Formula (1).

3. The electrophotographic photoreceptor according to claim 1, wherein the amount of the compound represented by Formula (2) and the compound represented by Formula (3) is in the range of approximately 25 parts by weight to 60 parts by weight in total relative to 100 parts by weight of the electron-transporting material represented by Formula (1).

4. The electrophotographic photoreceptor according to claim 1, wherein the amount of the compound represented by Formula (2) is in the range of approximately 10 parts by weight to 50 parts by weight relative to 100 parts by weight of the electron-transporting material represented by Formula (1).

5. The electrophotographic photoreceptor according to claim 1, wherein the amount of the compound represented by Formula (2) is in the range of approximately 15 parts by weight to 40 parts by weight relative to 100 parts by weight of the electron-transporting material represented by Formula (1).

6. A process cartridge comprising the electrophotographic photoreceptor according to claim 1, wherein the process cartridge is configured so as to be detachable from an image forming apparatus.

7. An image forming apparatus comprising:

the electrophotographic photoreceptor according to claim 1;

a charging unit that serves for charging the surface of the electrophotographic photoreceptor;

an electrostatic latent image-forming unit that serves for forming an electrostatic latent image on the charged surface of the electrophotographic photoreceptor;

a developing unit that serves for developing the electrostatic latent image on the surface of the electrophotographic photoreceptor with a developer containing toner to form a toner image; and a transfer unit that serves for transferring the toner image to the surface of a recording medium.

* * * * *